US011189895B1

(12) United States Patent
Wang

(10) Patent No.: US 11,189,895 B1
(45) Date of Patent: Nov. 30, 2021

(54) HYBRID DISTINCT WAVELENGTH RESONANT BAND-PASS FILTER WITH CAPACITIVE COUPLING METAL PATTERN

(71) Applicant: XIAMEN SUNYEAR ELECTRONICS CO., LTD, Xiamen (CN)

(72) Inventor: Junyuan Wang, Xiamen (CN)

(73) Assignee: XIAMEN SUNYEAR ELECTRONICS CO., LTD, Xiamen (CN)

( * ) Notice: Subject to any disclaimer, the term of this patent is extended or adjusted under 35 U.S.C. 154(b) by 0 days.

(21) Appl. No.: 16/952,017

(22) Filed: Nov. 18, 2020

(30) Foreign Application Priority Data

Aug. 20, 2020 (CN) ..... 202010841856.7

(51) Int. Cl.
*H01P 1/20* (2006.01)
*H01P 1/205* (2006.01)

(52) U.S. Cl.
CPC ..... *H01P 1/2053* (2013.01); *H01P 1/2056* (2013.01)

(58) Field of Classification Search
CPC ..... H01P 1/2053; H01P 1/20; H01P 1/2002; H01P 7/04; H01P 1/2056
USPC ..... 333/206, 207
See application file for complete search history.

(56) References Cited

U.S. PATENT DOCUMENTS 4,506,241 A * 3/1985 Makimoto ..... H01P 1/202 29/600
5,109,536 A * 4/1992 Kommrusch ..... H01P 1/2136 333/134
6,150,905 A * 11/2000 Nishijima ..... H01P 1/2056 333/206

* cited by examiner

*Primary Examiner* — Stephen E. Jones

(57) ABSTRACT

The present disclosure provides a hybrid distinct wavelength resonant band-pass filter with capacitive coupling metal pattern, including a ceramic matrix. The ceramic matrix includes a first surface and a second surface opposite to the first surface. A first resonant cavity, a second resonant cavity, a third resonant cavity, a fourth resonant cavity, a fifth resonant cavity, a sixth resonant cavity, a seventh resonant cavity, an eighth resonant cavity, and a ninth resonant cavity, sequentially distributing along a length direction of the ceramic matrix, are formed between the first surface and the second surface. A metal pattern is disposed on the first surface, the metal pattern includes a first pattern region surrounding the third resonant cavity and a second pattern region surrounding the fourth resonant cavity.

9 Claims, 6 Drawing Sheets

HYBRID DISTINCT WAVELENGTH RESONANT BAND-PASS FILTER WITH CAPACITIVE COUPLING METAL PATTERN

TECHNICAL FIELD

The present disclosure relates to a technical field of band-pass filters, in particular to a hybrid distinct wavelength resonant band-pass filter with capacitive coupling metal pattern.

BACKGROUND

Ceramic filters are divided into a band-stop filter (also known as trap filter) and a band-pass filter (also known as filter) according to amplitude-frequency characteristics, and is mainly used in frequency selection network, intermediate frequency tuning, frequency discrimination and filtering circuits to achieve a purpose of separating different frequency currents, and further has characteristics of being high in Q value, high in amplitude frequency, good in phase frequency characteristic, small in size, high in signal-to-noise ratio, etc. However, the band-pass filter is a filter that only allows signals within a specified one of frequency bands to pass and suppresses signals at other frequencies; the band-stop filter is a filter that suppresses the signals within the specified one of the frequency bands and allows the signals at other frequencies to pass. The present ceramic filters exist defects of having a single functional form and doing not meet full frequency requirements for frequency band usage.

The prior art 1-CN202010153329.7 discloses a hybrid distinct wavelength resonant band-pass filter with a capacitive coupling metal pattern. Five first resonant cavities, two second resonant cavities, and two third resonant cavities, which extend in a horizontal direction, are formed between a first surface and a second surface of a ceramic matrix. The two second resonant cavities and the five first resonant cavities are coupled to form a fifth order band-pass filter. The second resonant cavity and the third resonant cavity are respectively coupled to form two band-stop filters. Thus, filters having multiple different morphological functions are integrated into one body and have better out-of-band suppression capability at low frequencies (see FIGS. 1 and 2)

However, in some particular situations, the out-of-band suppression capability of the prior art 1 at low frequencies is still insufficient.

SUMMARY

In view of above, the present disclosure provides a hybrid distinct wavelength resonant band-pass filter with capacitive coupling metal pattern, which improves out-of-band suppression capability at low frequencies.

The present disclosure adopts the following technical measures.

The present disclosure provides the hybrid distinct wavelength resonant band-pass filter with capacitive coupling metal pattern, including a ceramic matrix. The ceramic matrix includes a first surface and a second surface opposite to the first surface. A first resonant cavity, a second resonant cavity, a third resonant cavity, a fourth resonant cavity, a fifth resonant cavity, a sixth resonant cavity, a seventh resonant cavity, an eighth resonant cavity, and a ninth resonant cavity, sequentially distributing along a length direction of the ceramic matrix, are formed between the first surface and the second surface. A metal pattern is disposed on the first surface, the metal pattern includes a first pattern region surrounding the third resonant cavity and a second pattern region surrounding the fourth resonant cavity. A first gap is formed between the first pattern region and the second pattern region such that the first pattern region and the second pattern region form capacitive coupling by separation of the first gap.

Furthermore, the metal pattern further includes a third pattern region surrounding the sixth resonant cavity and a fourth pattern region surrounding the seventh resonant cavity. A second gap is formed between the third pattern region and the fourth pattern region.

Furthermore, a shape of the first gap is consistent with a shape of the second gap, and the first gap is symmetrical with the second gap with respect to the fifth resonant cavity located in a middle of the first gap and the second gap.

Furthermore, adjacent surfaces of the first pattern region and the second pattern region are formed with regular or irregular twists to equivalently increase an electrode plate area.

Furthermore, a plurality of bends are formed on the adjacent surfaces of the first pattern region and the second pattern region.

Furthermore, the first resonant cavity, the third resonant cavity, the fourth resonant cavity, the fifth resonant cavity, the sixth resonant cavity, the seventh resonant cavity, and the ninth resonant cavity are one-half wavelength resonant cavities, and the second resonant cavity and the eighth resonant cavity are quarter-wavelength resonant cavities.

Furthermore, the second resonant cavity, the third resonant cavity, the fourth resonant cavity, the fifth resonant cavity, the sixth resonant cavity, the seventh resonant cavity, and the eighth resonant cavity are arranged on the ceramic matrix at a same height and are approximately disposed on a center of the first surface of the ceramic matrix. The first resonant cavity and the ninth resonant cavity are arranged on the ceramic matrix at a same height, and the height of the first resonant cavity is slightly lower than the height of the second resonant cavity.

Furthermore, both of the first resonant cavity and the ninth resonant cavity include a first section hole and a second section hole, and the first section hole is coaxial with the second section hole. A ratio of diameters of the first section hole and the second section hole is 1:1.1 to 1:2.5, and a ratio of lengths of the first section hole and the second section hole is 1:1 to 1:1.5.

Furthermore, the first resonant cavity and the ninth resonant cavity are equal-diameter holes.

Furthermore, the hybrid distinct wavelength resonant band-pass filter with capacitive coupling metal pattern further includes output-in electrodes, the output-in electrodes are electrically connected to each of the resonant cavities by the metal pattern.

According to the hybrid different-wavelength resonant band-pass filter with the capacitive coupling metal pattern, the first gap and the second gap are disposed to form capacitive coupling between the first pattern region and the second pattern region, and the third pattern region and the fourth pattern region, so that transmission zero energy of the band-pass filter is concentrated on a left side of a frequency domain, further, an out-of-band attenuation slope is larger, and a suppression effect is better improved.

DETAILED DESCRIPTION

In order to make objects, technical solutions, and advantages of the embodiments of the present disclosure clearer, the technical solutions of the embodiments of the present disclosure are clearly and completely described in connection with the accompanying drawings in the embodiments of the present disclosure, and obviously, the described embodiments are part of the embodiments of the present disclosure, not all embodiments. All other embodiments obtained by those skilled in the art based on the embodiments of the present disclosure without creative efforts are within scopes of the present disclosure. Thus, the following detailed description of embodiments of the present disclosure provided in the accompanying drawings is not intended to limit the scopes of the present disclosure, but is merely representative of selected embodiments of the present disclosure. All other embodiments obtained by those skilled in the art based on the embodiments of the present disclosure without creative efforts are within the scopes of the present disclosure.

In the description of the present disclosure, it should be understood that orientation or positional relationships indicated by terms "upper", "lower", etc. are based on orientation or positional relationships shown in figures, and are merely for a purpose of describing the present disclosure and the simplified description only but not intended to indicate or imply that an indicated device or element must have a particular orientation, constructed and operated in a particular orientation, and therefore not to be construed as a limitation of the present disclosure.

Furthermore, terms "first" and "second" are used for describing purposes only and are not to be understood as indicating or implying relative importance or implicitly specifying a number of technical features indicated. Thus, a feature that qualifies as "first" or "second" may explicitly or implicitly include one or more of such features. In the description of the present disclosure, "more than one" means two or more, unless expressly and specifically defined otherwise.

In the present disclosure, unless expressly specified and defined otherwise, terms "mounted", "connected", "connection", "fixed", etc. are to be construed broadly, for example, may be fixedly connected, may be detachably connected, or integral; may be a mechanical connection or an electrical connection; may be directly connected, may also be indirectly connected by an intermediate medium, or may be an interaction relationship between two elements. Specific meanings of the above-described terms in the present disclosure may be understood by those skilled in the art based on the specific circumstances.

The present disclosure is further described in details below in connection with the accompanying drawings and embodiments.

Figure 3:
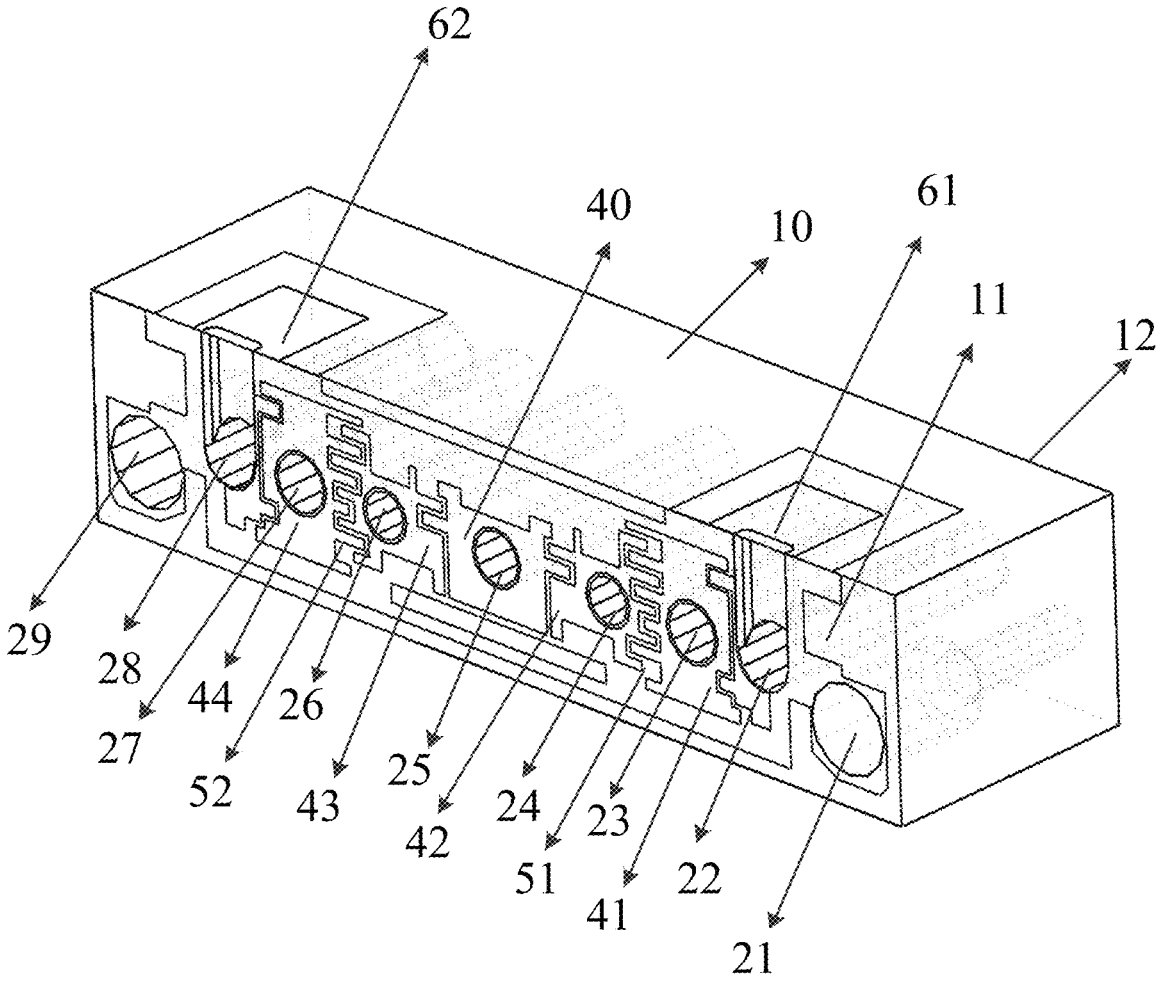
FIG. 3 is a perspective schematic diagram of a hybrid distinct wavelength resonant band-pass filter with capacitive coupling metal pattern according to one embodiment of the present disclosure.
Figure 4:
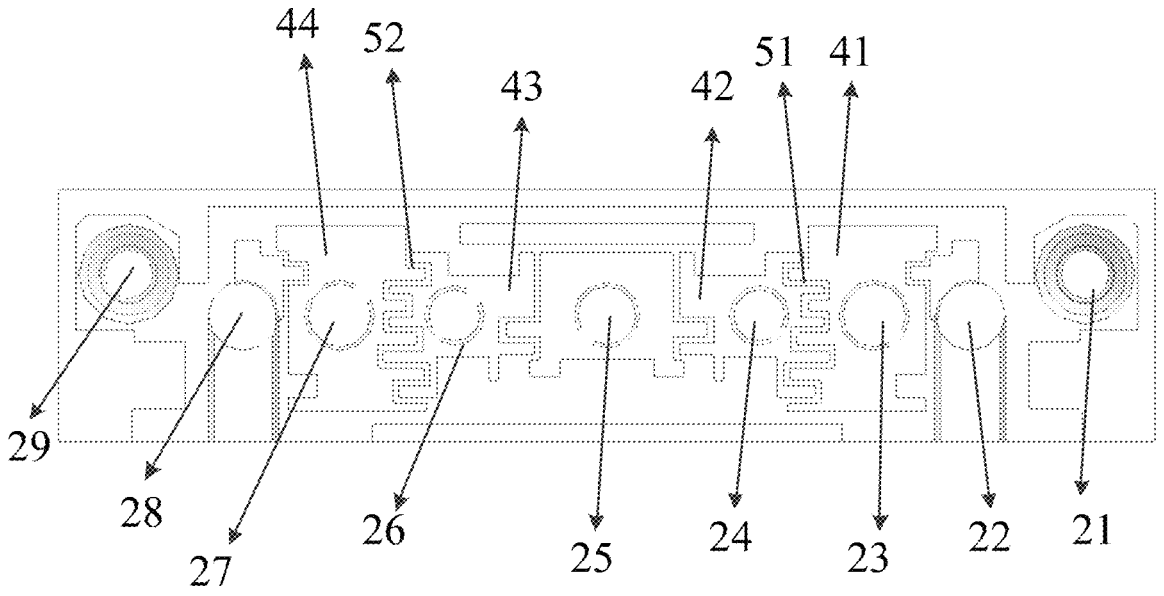
FIG. 4 is a plan schematic diagram of a first surface of the hybrid distinct wavelength resonant band-pass filter with capacitive coupling metal pattern according to one embodiment of the present disclosure.

As shown in FIG. 3-4, the present disclosure provides a hybrid distinct wavelength resonant band-pass filter with capacitive coupling metal pattern, including a ceramic matrix 10. The ceramic matrix 10 includes a first surface 11 and a second surface 12 opposite to the first surface 11. A first resonant cavity 21, a second resonant cavity 22, a third resonant cavity 23, a fourth resonant cavity 24, a fifth resonant cavity 25, a sixth resonant cavity 26, a seventh resonant cavity 27, an eighth resonant cavity 28, and a ninth resonant cavity 29, sequentially distributing along a length direction of the ceramic matrix 10, are formed between the first surface 11 and the second surface 12. A metal pattern 40 is disposed on the first surface 11, the metal pattern 40 includes a first pattern region 41 surrounding the third resonant cavity 23 and a second pattern region 42 surrounding the fourth resonant cavity 24. A first gap 51 is formed between the first pattern region 41 and the second pattern region 42 such that the first pattern region 41 and the second pattern region 42 form capacitive coupling by separation of the first gap 51.

Specifically, in one embodiment, the ceramic matrix 10 is generally rectangular in structure, and the ceramic matrix 10 may be made of a dielectric ceramic or other organic dielectric materials. Preferably, the ceramic matrix 10 is a high dielectric ($\varepsilon\gamma$=8~20) microwave material.

In one embodiment, the third resonant cavity 23, the fourth resonant cavity 24, the fifth resonant cavity 25, the sixth resonant cavity 26, and the seventh resonant cavity are disposed near a middle of the first surface 11 of the ceramic matrix 10. The second resonant cavity 22 is disposed on an outer side of the third resonant cavity 23, and the eighth resonant cavity 28 is disposed on an outer side of the seventh resonant cavity. The first resonant cavity 21 is disposed on an outer side of the second resonant cavity 22, and the ninth resonant cavity 29 is disposed on an outer side of the eighth resonant 28.

In one embodiment, the second resonant cavity 22, the third resonant cavity 23, the fourth resonant cavity 24, the fifth resonant cavity 25, the sixth resonant cavity 26, the seventh resonant cavity 27, and the eighth resonant cavity 28 are arranged on the ceramic matrix 10 at a same height and are approximately disposed on a center of the first surface 11 of the ceramic matrix 10. The first resonant cavity 21 and the ninth resonant cavity 29 are arranged on the ceramic matrix 10 at a same height, and the height of the first resonant cavity 21 is slightly lower than the height of the second resonant cavity 22, further, the height of the first resonant cavity 21 may also be slightly higher than the height of the second resonant cavity 22. Thus, an overall length of the ceramic matrix 10 is decreased, and an overall volume of the hybrid distinct wavelength resonant band-pass filter is reduced.

In one embodiment, resonant frequency of the hybrid distinct wavelength resonant band-pass filter may be adjusted by adjusting heights of the resonant cavities disposed on the ceramic matrix 10, such that the resonant frequency of the hybrid distinct wavelength resonant band-pass filter reaches a desired frequency point position to form a resonance. A specific height depends on situations and is not specifically limited by the present disclosure.

In one embodiment, the first resonant cavity 21, the third resonant cavity 23, the fourth resonant cavity 24, the fifth resonant cavity 25, the sixth resonant cavity 26, the seventh resonant cavity 27, and the ninth resonant cavity 29 are one-half wavelength resonant cavities, and the second resonant cavity 22 and the eighth resonant cavity 28 are quarter-wavelength resonant cavities. Both of the first resonant cavity 21 and the ninth resonant cavity 29 include a first section hole and a second section hole, and the first section hole is coaxial with the second section hole. A ratio of diameters of the first section hole and the second section hole is 1:1.1 to 1:2.5, and a ratio of lengths of the first section hole and the second section hole is 1:1 to 1:1.5. Certainly, it should be noted that the ratios of the diameters or lengths of the two sections can be adjusted according to actual needs, all within the scopes of the present disclosure.

In one embodiment, each of the resonant cavities is coated with metal. The first resonant cavity 21, the third resonant cavity 23, the fourth resonant cavity 24, the fifth resonant cavity 25, the sixth resonant cavity 26, the seventh resonant cavity 27, and the ninth resonant cavity 29 are coated with the metal at one end located on the second surface 12. The third resonant cavity 23, the fourth resonant cavity 24, the fifth resonant cavity 25, the sixth resonant cavity 26, and the seventh resonant cavity 27 are coupled to form a fifth order band-pass filter. The first resonant cavity 21 and the second resonant cavity 22 are coupled to form a band-stop filter. The ninth resonant cavity 29 and the eighth resonant cavity 28 are also coupled to form a band-stop filter.

In one embodiment, a first gap 51 is formed between the first pattern region 41 and the second pattern region 42 such that the first pattern region 41 and the second pattern region 42 form capacitive coupling by separation of the first gap 51. That is, two adjacent surfaces of the first pattern region 41 and the second pattern region 42 constructs two electrode plates of a capacitor, while first gap 51 in the middle serves as an insulating medium for the capacitor.

It should be noted that, in one embodiment, in order to enhance coupling capability of the capacitor, the adjacent surfaces of the first pattern region 41 and the second pattern region 42 are formed with regular or irregular twists to equivalently increase an electrode plate area. For example, the adjacent surfaces of the first pattern region 41 and the second pattern region 42 may be formed with a plurality of continuous and mutually matched bends to maximize the electrode plate area.

In one embodiment, the capacitive coupling is formed by the first pattern region 41 and the second pattern region 42, so that transmission zero energy of the band-pass filter is concentrated on a left side of a frequency domain, further, an out-of-band attenuation slope is larger, and a suppression effect is better improved.

It should be noted that, similarly, the metal pattern 40 further includes a third pattern region 43 surrounding the sixth resonant cavity 26 and a fourth pattern region 44 surrounding the seventh resonant cavity 27. A second gap 52 is formed between the third pattern region 43 and the fourth pattern region 44, so that the third pattern region 43 and the fourth pattern region 44 form the capacitive coupling.

Figure 1:
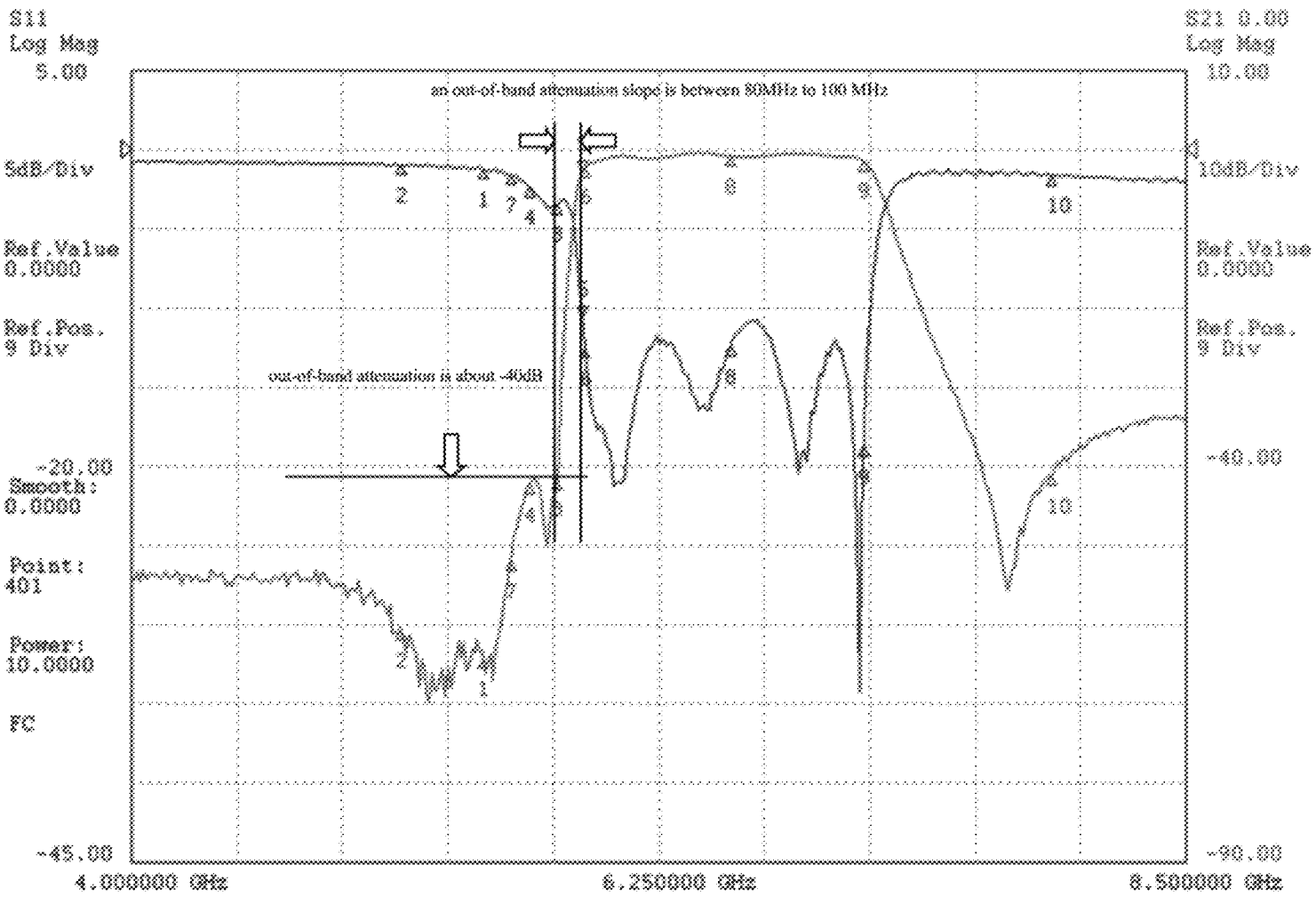
Prior Art FIG. 1
FIG. 1 is an electrical plot of out-of-band attenuation of the prior art 1 at a first zero.
Figure 2:
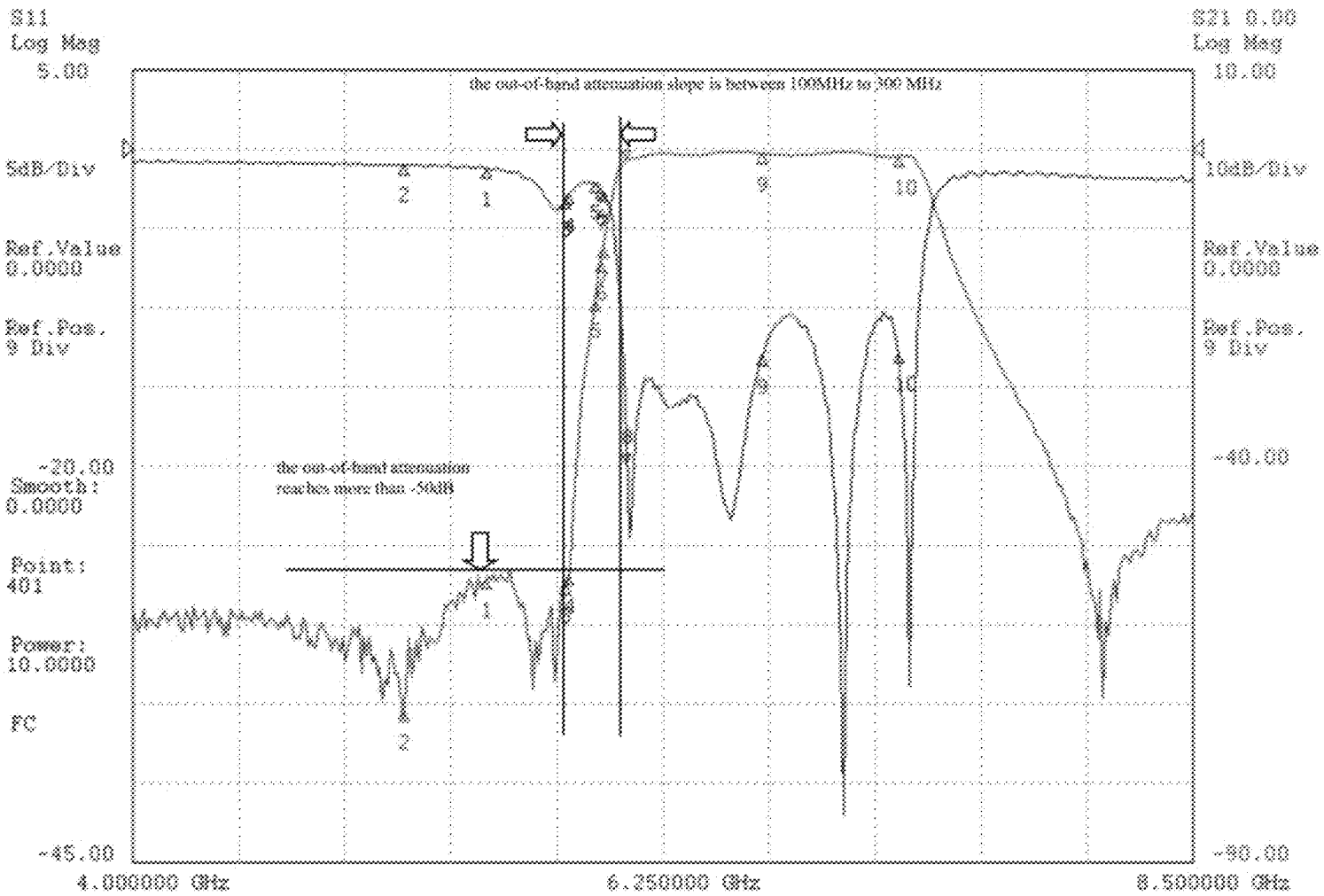
Prior Art FIG. 2
FIG. 2 is an electrical plot of out-of-band attenuation of the prior art 1 at a second zero.
Figure 5:
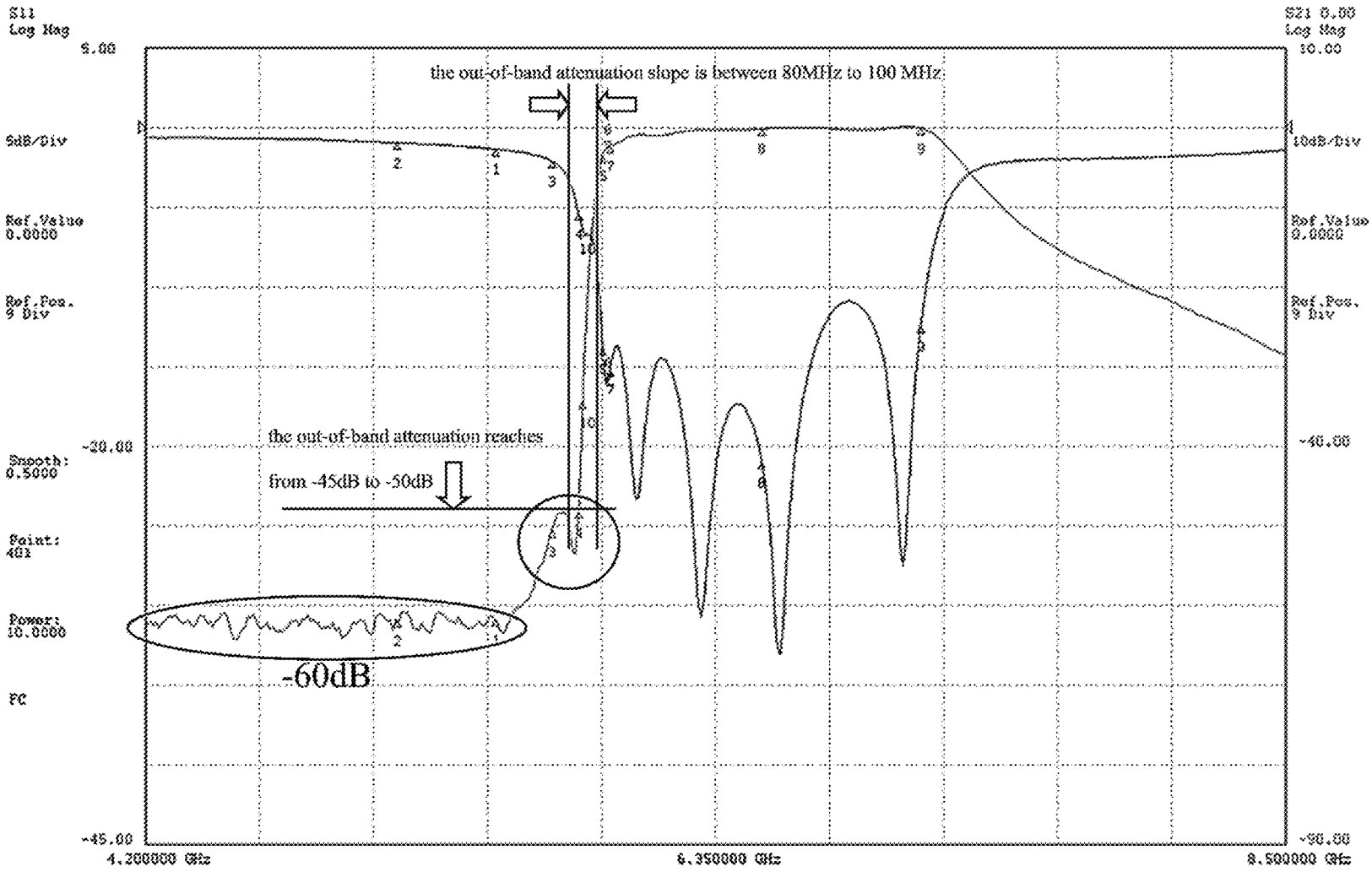
FIG. 5 is an electrical plot of out-of-band attenuation of the hybrid distinct wavelength resonant band-pass filter with capacitive coupling metal pattern at a first zero according to one embodiment of the present disclosure.
Figure 6:
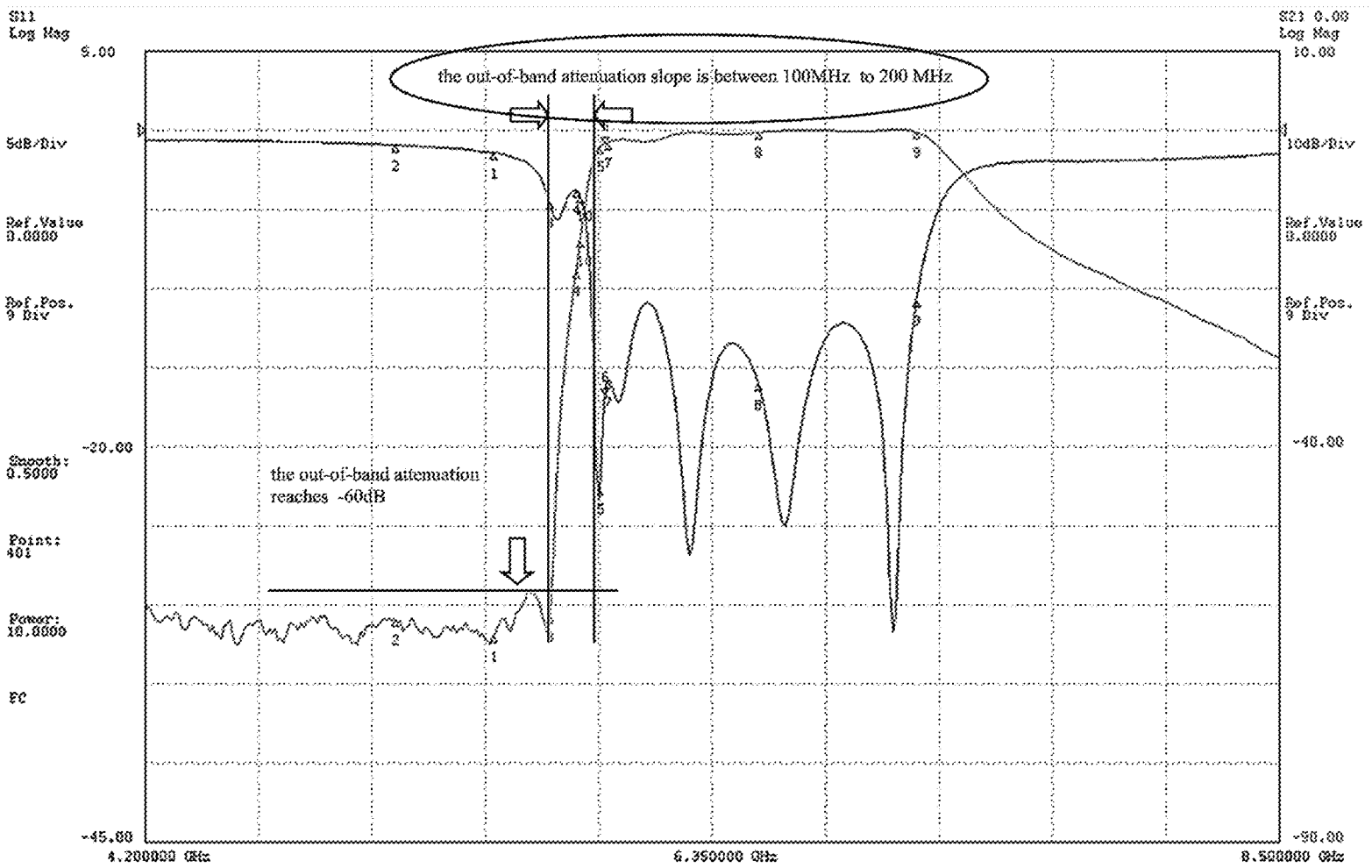
FIG. 6 is an electrical plot of out-of-band attenuation of the hybrid distinct wavelength resonant band-pass filter with capacitive coupling metal pattern at a second zero according to one embodiment of the present disclosure.

As shown in FIG. 5, compared with the prior art 1, in one embodiment, at a first zero, the out-of-band attenuation increases from −40 dB shown in FIG. 1 to −50 dB. At a second zero, the out-of-band attenuation increases from −50 dB shown in FIG. 2 to −60 dB shown in FIG. 6. The out-of-band attenuation slope decreases from 100-300 MHz shown in FIG. 2 to 100-200 MHz shown in FIG. 6.

In view of above, according to the hybrid different-wavelength resonant band-pass filter with the capacitive coupling metal pattern, the first gap 51 and the second gap 52 are disposed to form capacitive coupling between the first pattern 41 region and the second pattern region 42, and the third pattern region 43 and the fourth pattern region 44, so that transmission zero energy of the band-pass filter is concentrated on the left side of the frequency domain, further, the out-of-band attenuation slope is larger, and the suppression effect is better improved.

In one embodiment, the hybrid different-wavelength resonant band-pass filter with the capacitive coupling metal pattern further includes a first output-in electrode 61 and a second output-in electrode 62. The first output-in electrode 61 and the second output-in electrode 62 are disposed on the first surface 11 and are respectively connected with each of the resonant cavities. The first output-in electrode 61 and the second output-in electrode 62 are covered on the ceramic matrix 10 in a screen-printing manner, or by means of high-temperature metallizing silver electrode, so that the silver electrode and the ceramic matrix 10 are connected together, and a conductive metal layer is also formed to cover on an outer surface of the ceramic substrate 10 using laser etching, etc.

The foregoing are merely better examples of the present disclosure and are not intended to limit the present disclosure, and any modifications, equivalent replacements, improvements, etc. made within the spirit and principles of the present disclosure should be included within the scopes of the protection of the present disclosure.

What is claimed is:

1. A hybrid distinct wavelength resonant band-pass filter with capacitive coupling metal pattern, comprising:

a ceramic matrix, wherein the ceramic matrix comprises a first surface and a second surface opposite to the first surface;

a first resonant cavity, a second resonant cavity, a third resonant cavity, a fourth resonant cavity, a fifth resonant cavity, a sixth resonant cavity, a seventh resonant cavity, an eighth resonant cavity, and a ninth resonant cavity, sequentially distributed along a length direction of the ceramic matrix, and are formed between the first surface and the second surface;

a metal pattern disposed on the first surface, wherein the metal pattern comprises a first pattern region surrounding the third resonant cavity and a second pattern region surrounding the fourth resonant cavity;

a first gap is formed between the first pattern region and the second pattern region such that the first pattern region and the second pattern region form capacitive coupling by separation of the first gap; and the first resonant cavity, the third resonant cavity, the fourth resonant cavity, the fifth resonant cavity, the sixth resonant cavity, the seventh resonant cavity, and the ninth resonant cavity are one-half wavelength resonant cavities, and the second resonant cavity and the eighth resonant cavity are quarter-wavelength resonant cavities.

2. The hybrid distinct wavelength resonant band-pass filter with capacitive coupling metal pattern according to claim 1, wherein the second resonant cavity, the third resonant cavity, the fourth resonant cavity, the fifth resonant cavity, the sixth resonant cavity, the seventh resonant cavity, and the eighth resonant cavity are arranged on the ceramic matrix at a same height and are approximately disposed on a center of the first surface of the ceramic matrix; the first resonant cavity and the ninth resonant cavity are arranged on the ceramic matrix at a same height, and the height of the first resonant cavity is slightly lower than the height of the second resonant cavity.

3. The hybrid distinct wavelength resonant band-pass filter with capacitive coupling metal pattern according to claim 1, wherein the metal pattern further comprises a third pattern region surrounding the sixth resonant cavity and a fourth pattern region surrounding the seventh resonant cavity; and a second gap is formed between the third pattern region and the fourth pattern region.

4. The hybrid distinct wavelength resonant band-pass filter with capacitive coupling metal pattern according to claim 3, wherein a shape of the first gap is consistent with a shape of the second gap, and the first gap is symmetrical with the second gap with respect to the fifth resonant cavity located in a middle of the first gap and the second gap.

5. The hybrid distinct wavelength resonant band-pass filter with capacitive coupling metal pattern according to claim 3, further comprising output-in electrodes, the output-in electrodes are electrically connected to each of the resonant cavities by the metal pattern.

6. The hybrid distinct wavelength resonant band-pass filter with capacitive coupling metal pattern according to claim 1, wherein adjacent surfaces of the first pattern region and the second pattern region are formed with regular or irregular twists to equivalently increase an electrode plate area.

7. The hybrid distinct wavelength resonant band-pass filter with capacitive coupling metal pattern according to claim 6, wherein a plurality of bends are formed on the adjacent surfaces of the first pattern region and the second pattern region.

8. The hybrid distinct wavelength resonant band-pass filter with capacitive coupling metal pattern according to claim 1, wherein both of the first resonant cavity and the ninth resonant cavity comprise a first section hole and a second section hole, and the first section hole is coaxial with the second section hole; a ratio of diameters of the first section hole and the second section hole is 1:1.1 to 1:2.5, and a ratio of lengths of the first section hole and the second section hole is 1:1 to 1:1.5.

9. The hybrid distinct wavelength resonant band-pass filter with capacitive coupling metal pattern according to claim 8, wherein the first resonant cavity and the ninth resonant cavity are equal-diameter holes.

* * * * *